US010064503B2

(12) United States Patent
Bacallao

(10) Patent No.: US 10,064,503 B2
(45) Date of Patent: Sep. 4, 2018

(54) MODULAR BAGGING APPARATUS FOR WEIGHT SCALE

(71) Applicant: Wal-Mart Stores, Inc., Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/622,146

(22) Filed: Jun. 14, 2017

(65) Prior Publication Data

US 2017/0354274 A1 Dec. 14, 2017

Related U.S. Application Data

(63) Continuation-in-part of application No. 29/567,968, filed on Jun. 14, 2016.

(60) Provisional application No. 62/349,933, filed on Jun. 14, 2016, provisional application No. 62/349,940, filed on Jun. 14, 2016.

(51) Int. Cl.
*A47F 9/04* (2006.01)

(52) U.S. Cl.
CPC ..... *A47F 9/042* (2013.01); *A47F 9/047* (2013.01)

(58) Field of Classification Search
CPC .... A47F 9/00; A47F 9/04; A47F 9/042; A47F 9/047
See application file for complete search history.

(56) References Cited

U.S. PATENT DOCUMENTS

| | | | | |
|---|---|---|---|---|
| 2,884,094 | A | 4/1959 | Roy | |
| 3,902,570 | A * | 9/1975 | Close | A47F 9/042 186/66 |
| 4,703,151 | A * | 10/1987 | Sakamoto | F24C 7/08 177/210 FP |
| 5,131,499 | A | 7/1992 | Hoar | |
| 5,816,419 | A | 10/1998 | Lamson | |
| 6,491,218 | B2 * | 12/2002 | Nguyen | A47F 9/045 211/115 |
| 6,550,583 | B1 * | 4/2003 | Brenhouse | A47F 9/042 186/61 |
| 6,793,043 | B2 | 9/2004 | Nguyen | |
| 7,114,650 | B2 | 10/2006 | Sherrod | |
| 7,516,820 | B1 | 4/2009 | Cox et al. | |

(Continued)

FOREIGN PATENT DOCUMENTS

CA 2714538 A1 3/2012

OTHER PUBLICATIONS

"Grocery checkstands catalog", PanOston.com, 2011, revised Oct. 2012; 47 pages.

(Continued)

*Primary Examiner* — Mark J Beauchaine
(74) *Attorney, Agent, or Firm* — Schmeiser, Olsen & Watts LLP

(57) ABSTRACT

A mobile, modular bagging station comprises a rotatable carousel base constructed and arranged for positioning on a self-checkout scale platform; a center piece coupled to a top surface of the carousel base; and a plurality of holding elements extending from the top portion. A weight of a plurality of store items in shopping bags positioned on the holding elements is determined by the scale platform on which the carousel base is positioned.

14 Claims, 7 Drawing Sheets

(56) References Cited

U.S. PATENT DOCUMENTS

| | | | | |
|---|---|---|---|---|
| 7,578,440 | B2 | 8/2009 | Ulrich et al. | |
| 7,866,546 | B1 * | 1/2011 | Vance | G07G 1/14 235/379 |
| 2003/0141367 | A1 | 7/2003 | Lucera et al. | |
| 2004/0041021 | A1 | 3/2004 | Nugent, Jr. | |
| 2005/0114216 | A1 * | 5/2005 | Lantz | A47F 9/045 705/16 |
| 2007/0205277 | A1 | 9/2007 | Tashiro | |
| 2011/0266092 | A1 | 11/2011 | Marquis et al. | |
| 2012/0055982 | A1 * | 3/2012 | Edwards | G01G 19/4144 235/375 |
| 2012/0061150 | A1 | 3/2012 | Coulombe et al. | |

OTHER PUBLICATIONS

Bushman Communications, "Cushman(TM) Refresher(R) Family", YouTube.com, Jan. 15, 2016, (3 pages).

"Pull-Out Trash Can Cabinet", CliqStudios.com, accessed Jun. 7, 2016; 3 pages.

"19 in. H x 11 in. W x 22 in. D Single 35 Qt. Pull-Out Brushed Aluminum and White Waste Container", HomeDepot.com, accessed Jun. 7, 2016; 2 pages.

ValentinoDesigns "Reclaimed Barn Wood Kitchen Island with Drawers cabinet Slide Out Trash Can Shelf Breakfast bar 48 X 35 X 26", Etsy.com, accessed Jun. 2, 2016; 2 pages.

Examiner's Report in Canadian Application for Industrial Design No. 171721, dated Mar. 3, 2017; 10 pages.

Invitation to Pay Additional Fees in International Patent Application No. PCT/US17/37359, dated Aug. 15, 2017; 2 pages.

International Search Report & Written Opinion in International Patent Application No. PCT/US17/37359, dated Oct. 31, 2017; 11 pages.

Non-Final Office Action in U.S. Appl. No. 15/622,136, dated Jan. 4, 2018; 12 pages.

Final Office Action in U.S. Appl. No. 15/622,136 dated May 1, 2018; 12 pages.

Notice of Allowance in U.S. Appl. No. 15/622,136 dated Jul. 11, 2018; 8 pages.

* cited by examiner

MODULAR BAGGING APPARATUS FOR WEIGHT SCALE

RELATED APPLICATIONS

This application is a Continuation-in-Part of U.S. Design patent application No. 29/567,968, filed Jun. 14, 2016 and entitled "Bagging Apparatus", and claims the benefit of U.S. Provisional Patent Application No. 62/349,933, filed Jun. 14, 2016 and entitled "Modular Bagging Stations", and U.S. Provisional Patent Application No. 62/349,940, filed Jun. 14, 2016 and entitled "Self-Checkout Register Configurations" the contents of which are incorporated herein in their entirety.

BACKGROUND OF THE INVENTION

Technical Field

The present inventive concepts relate to a mobile bagging apparatus, and more specifically to weigh stations configured a bagging apparatus.

State of the Art

A bagging station is a station in a retail store where purchases are placed into bags so that the bags, with the purchases, may be carried out of the store by the customer. Bagging stations are often designed to hold a plurality of bags, and have a ledge or shelf where a customer or bagger can set the bag while it is being filled.

Accordingly, what is needed is a modular, ergonomically friendly bagging station that allows for bagging options when used in connection with a checkout register scale platform in a retail establishment, or other weigh station where items are temporarily placed and weighed, for example, a self-checkout bagging station, an airport terminal, and so on.

SUMMARY

In one aspect, provided is a mobile, modular bagging station comprising: a rotatable carousel base constructed and arranged for positioning on a self-checkout scale platform; a center piece coupled to a top surface of the carousel base; and a plurality of holding elements extending from the top portion, wherein a weight of a plurality of store items in shopping bags positioned on the holding elements is determined by the scale platform on which the carousel base is positioned.

In another aspect, provided is a system for self-checkout of store items, comprising: self-checkout scale platform; a bagging station on the self-checkout scale platform and rotates about an axis perpendicular to the scale platform, wherein the self-checkout scale platform weighs a plurality of store items in shopping bags hanging from the bagging station; and a weight calculator that compares a weight of the store items in the shopping bags hanging from the bagging station, and a weight of the items upstream from the bagging station.

In another aspect, provided is a method for security at a weigh station, comprising: positioning a modular bagging station on a scale platform; positioning a plurality of shopping bags on the bagging station; inserting store items purchased upstream from the scale platform into the shopping bags; weighing by the scale platform the items in the shopping bags on the bagging station; and comparing a weight result with a weight of the items determined upstream from the bagging station.

DETAILED DESCRIPTION OF EMBODIMENTS

Embodiments include a self-checkout system where a customer purchases store items prior to leaving the store. A typical self-checkout system requires a customer to scan item barcodes or other identifiers, input the types of items such as fruit and vegetable, for example, using a touchscreen display, weigh the items, if applicable, and place all scanned items into a bagging area. The weight observed in the bagging area is verified against previously stored information to ensure that the correct item is bagged, allowing the customer to proceed only if the observed and expected weights match. The self-checkout station includes processors or the likes for communicating with the store computers, tallying the items and feeding the purchase information into accounting and inventory databases just as if it were a regular checkout lane with a cashier.

Aspects of the present inventive concepts include a mobile bagging station that can be part of a scale in the bagging area of a self-checkout counter, so that items purchased at the self-checkout system can be placed in bags which in turn are positioned on the mobile bagging station, and verified to determine whether the items in the bags are correct.

Figure 1:
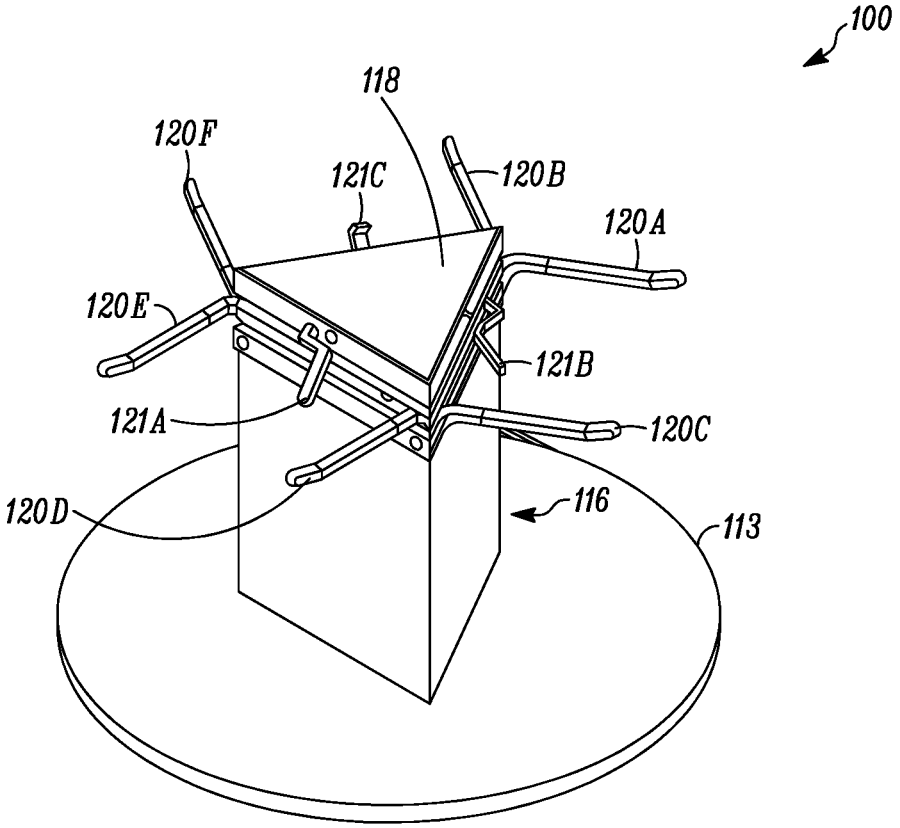
FIG. 1 is a perspective view of a modular bagging station for a self-checkout system, in accordance with some embodiments.
Figure 2:
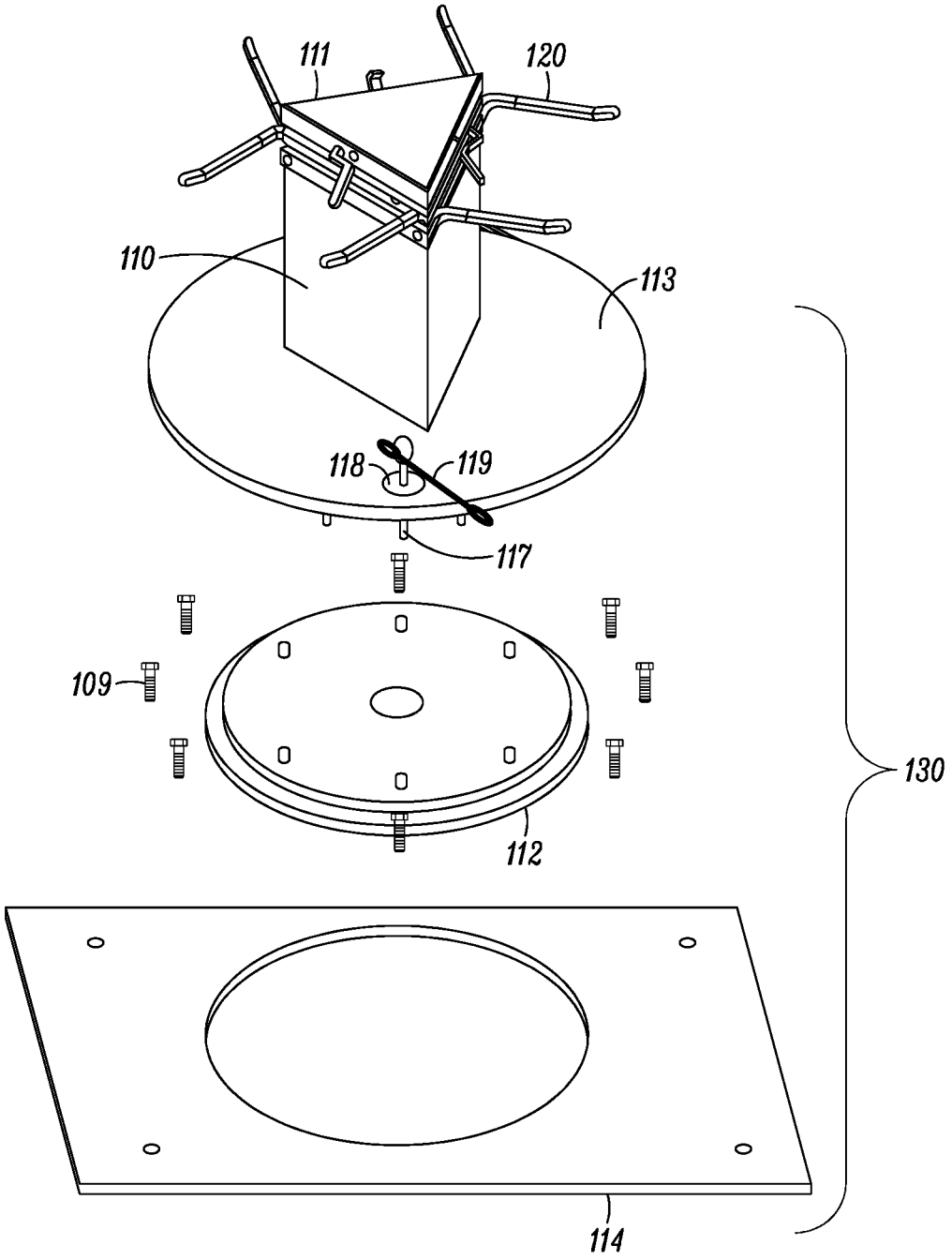
FIG. 2 is a perspective view of the modular bagging station of FIG. 1 and an exploded view of the base of the bagging station, in accordance with some embodiments.
Figure 3A:
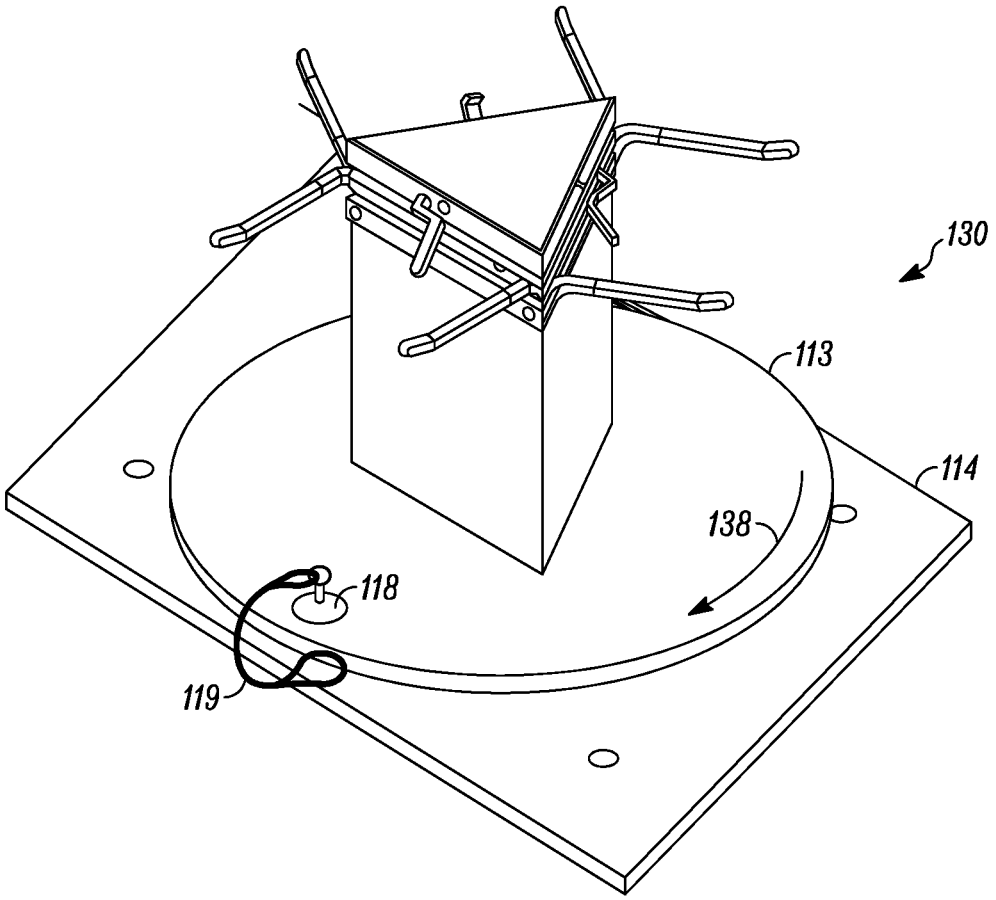
FIG. 3A is a perspective view of the modular bagging station of FIGS. 1 and 2 assembled in accordance with some embodiments.
Figure 3B:
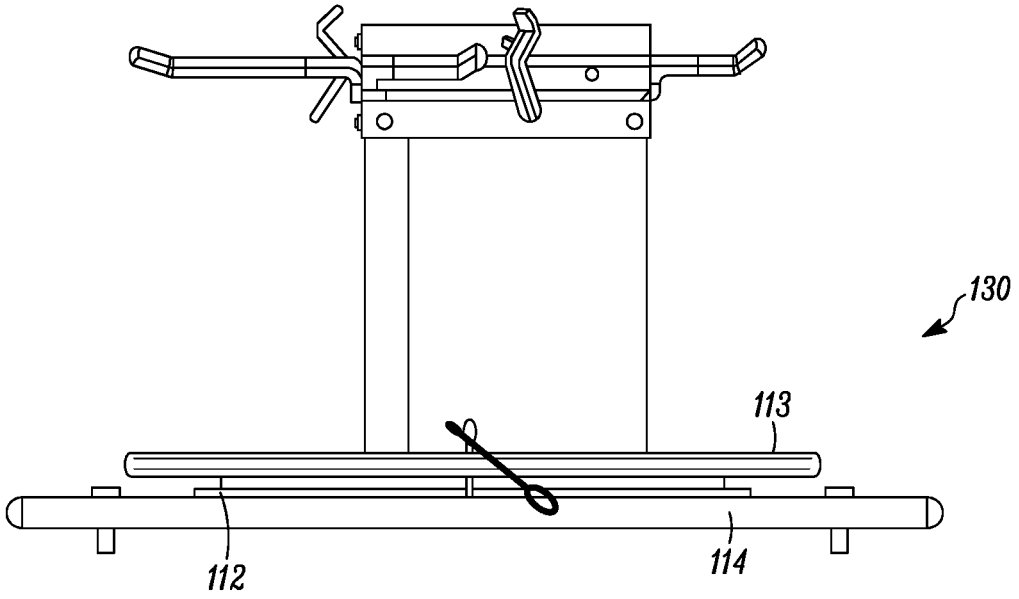
FIG. 3B is a front view of the modular bagging station of FIGS. 1-3A.

FIGS. 1-4 illustrate various views of a modular bagging station 100 for a self-checkout system, in accordance with some embodiments. In particular, FIG. 1 is a perspective view of a modular bagging station 100 for a self-checkout system, in accordance with some embodiments, FIG. 2 is a perspective view of the modular bagging station of FIG. 1 and an exploded view of the base 130 of the bagging station 100, in accordance with some embodiments, FIG. 3A is a perspective view of the modular bagging station 100 of FIGS. 1 and 2 assembled in accordance with some embodiments, FIG. 3B is a front view of the modular bagging station 100 of FIGS. 1-3A, and FIG. 4 is a perspective view of a modular bagging station 100 in communication with a self-checkout register scale platform, in accordance with some embodiments. Although embodiments refer to an application of a self-checkout station, other embodiments may equally apply to a store checkout counter occupied by a store clerk or other employee, for example, a store representative who scans the items, collects payment, confirms authenticity of purchase, and so on.

Figure 4:
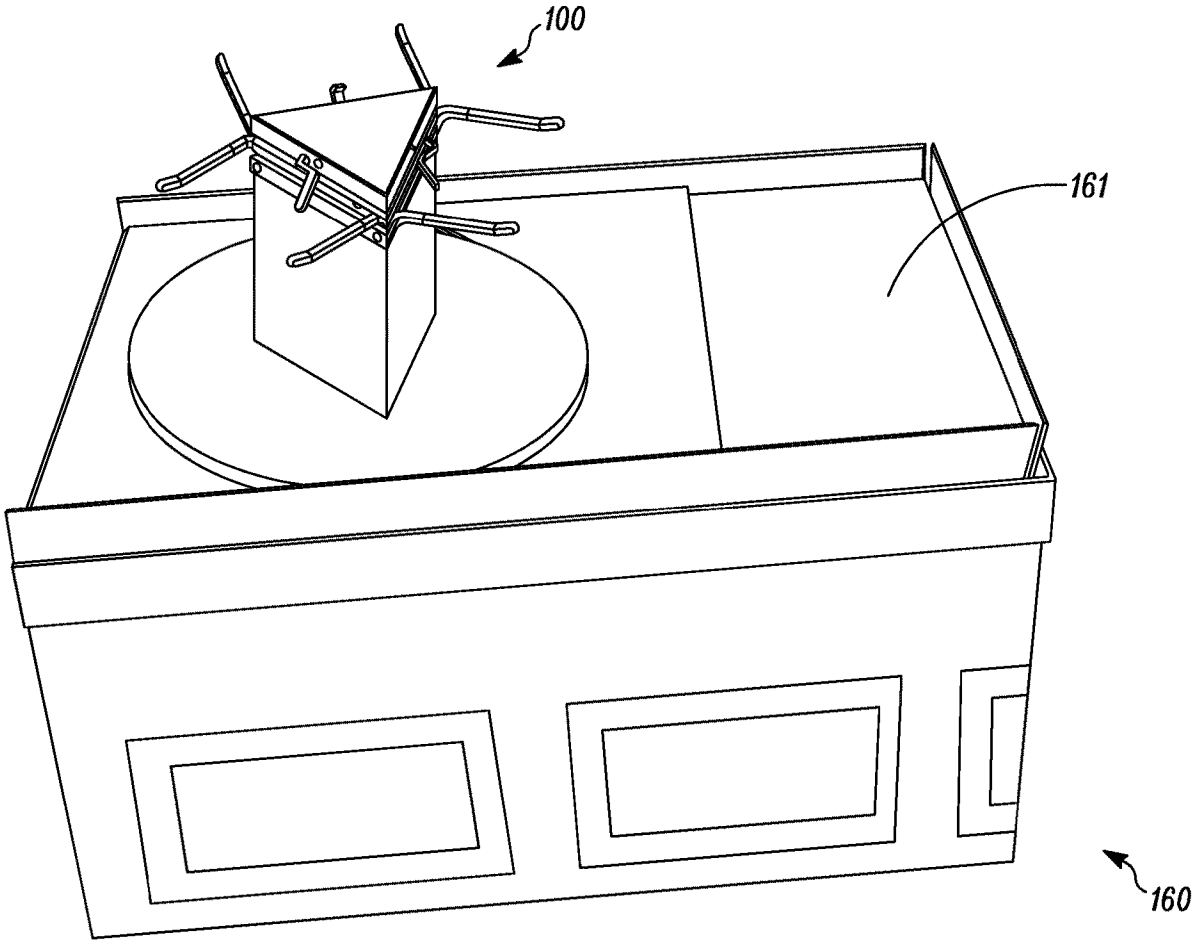
FIG. 4 is a perspective view of a modular bagging station in communication with a self-checkout register scale platform, in accordance with some embodiments.

The bagging station 100 is preferably constructed and arranged for positioning on a self-checkout register scale platform 160, for example, shown in FIG. 4, but is not limited thereto. For example, the bagging station 100 may be positioned at other locations of a self-checkout system, preferably a designated bagging area. As described herein, the bagging stations 110 is preferably modular, for holding shopping bags configured to receive store items to be weighed. In another example, the bagging station 100 is constructed and arranged for positioning on a weight scale at an airport or other security-sensitive area.

Figure 4A:
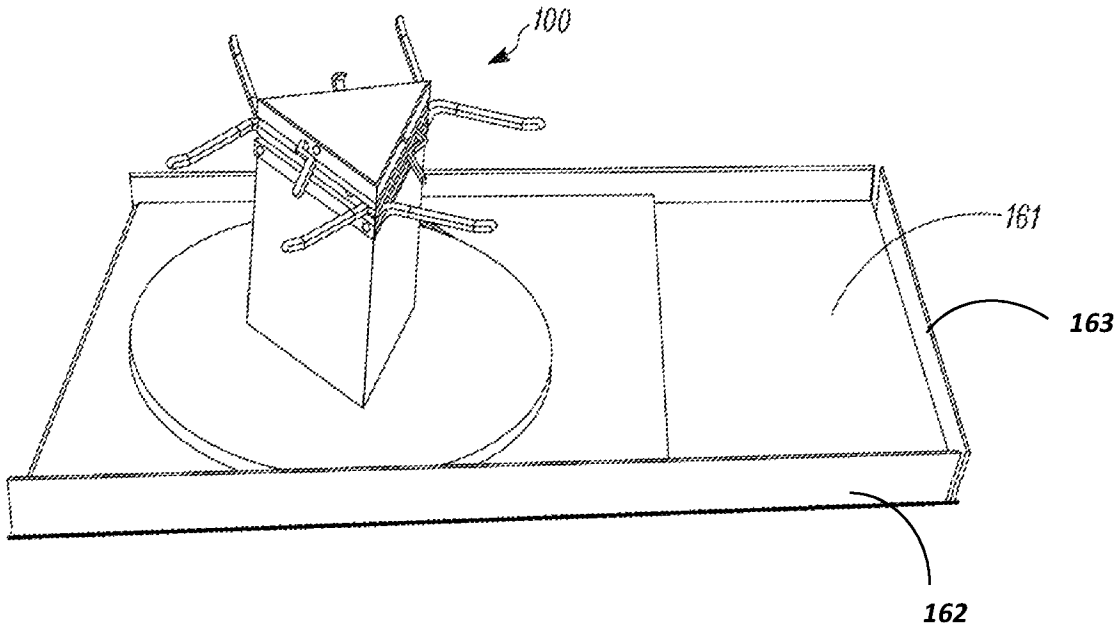
FIG. 4A is a perspective view of the modular bagging station of FIG. 4 removed from the self-checkout register scale platform.

The bagging station 100 may include a carousel top 113, a center piece 116, and a plurality of bag holding elements 120A-120F extending from the center piece 116. The carousel top 113 may be part of a base 130, for example, shown in FIGS. 2-3B. Alternatively, the carousel top 113 may be integrated with a region of a self-checkout system, for example, part of a scale. In some embodiments, the carousel top 113 rotates, and the center piece 116 sets on the carousel top 113. As shown in FIGS. 4 and 4A, the bagging station 100 may be coupled to a metal base 162, which is inserted into and positioned on a scale platform 160.

Base 130, or more specifically, carousel top 113, acts as a table to hold center piece 116, and is a means to support one or more paper bags while a paper bag is being filled with store items for purchase.

As shown in FIG. 2, the base 130 can include the carousel top 113, a bearing plate 112, and an adapter plate 114, whereby the carousel top 113 can rotate about its axis relative to the stationary adapter plate 114 for ease of access to multiple shopping bags hanging from the top portion 118, or lid, of the center piece 116.

In some embodiments, the bearing plate 112 includes a plurality of ball bearings or the like, permitting a region of separation between the carousel top 113 and the adapter plate 114. The carousel top 113 can rotate relative to the adapter plate 114 due to the ball bearings or the like of the bearing plate 112.

Center piece 116 in this embodiment rests on, and is coupled to, a top surface of carousel top 113. In some embodiments, center piece 116 has three sides, or a triangular configuration. In some embodiments, center piece 116 has more than three sides, and top surface 118 is a shape other than triangular, such as rectangular, round, oval, or other shape. In some embodiments, a coupling mechanism 119 is provided, for example, a pin or the like, to maintain a stationary position of the rotatable top portion 118, for example, when not in use.

The bag holding elements 120A-120F (generally, 120) may include hooks, rods, clamps, spring clips or other extensions for holding a shopping bag and its contents. A shopping bag may be paper, plastic, recyclable material, and/or other well-known material. The elements 120 may include bag upper edge holders 121 that grasp the upper edge of an open bag in order to hold the bag open and in place while items are placed in the bag so the bag can be filled. In some embodiments, bagging station 100 does not include shopping bag edge holders 121. In the embodiment shown, bagging station 100 includes six paper bag holding elements 120A-F extending from triangular corners of the top portion 118 of the center piece 116. Additional bag edge holders 121A-C may be attached to the sides of center piece 116, each between two bag holding elements 120A-120F. Bag edge holders 121A-C may be constructed and arranged to include hooks, rods, clamps, spring clips or other extensions for holding a shopping bag and its contents. The bag holding elements 120A-120F and/or bag edge holders 121A-C may be of various sizes and shapes for supporting the weight of a shopping bag filled with store items. The bag edge holders 121A-C may have a different configuration than holding elements 120A-F, or a similar or same configuration. In some embodiments, the bag holding elements 120A-120F and/or bag edge holders 121A-C may be removable, for example, removed from the top portion 118 of the center piece 116 and replaced with different the bag holding elements 120A-120F and/or bag edge holders 121A-C.

As described with respect to some embodiments, the modular bagging station 100 is constructed and arranged to communicate with a self-checkout register scale platform 160, for example, rest on the scale platform 160. The scale platform 160 may function as an antitheft scale. In another example, the scale platform may be a weight scale at a security-sensitive area such as an airport, where baggage is first weighed during a check in procedure, then weighed again prior to loading onto the airplane to determine whether a weight difference is present between the two weigh-ins, and determine whether items were added to or removed from the baggage after the initial check in. A central database (not shown) in electrical communication with a processor of the scale platform 160 may store the standard weight of each grocery item, which may be predetermined, or by another scale as part of the checkout process, for example, during the scanning and payment portions of a scanning process. An alarm or other notification may be sounded if the added weight does not match the item that was scanned.

As shown in FIG. 4, in some embodiments, the scale platform 160 includes a top surface on which a metal base 162 including a lip 163 may be positioned, in turn on which items may be placed and weighed. A portion of the top surface may be configured to mate with the metal base 162, for example, the top surface of the scale platform 160 may include an opening to receive the carousel top 113, bearing plate 112, and base 162, which is coupled to, integrated with, or otherwise positioned at the scale platform 160 whereby the carousel top 113 may rotate about the base 162 due to the bearing plate 112. In some embodiments, the adapter plate 114 shown in FIG. 3A may be coupled to the surface 161 of the base 162. In other embodiments, the lip 163 may be provided with no corresponding metal bottom. Here, the lip 163 may be coupled directly to the sides of the scale platform 160, while the carousel top 113, bearing plate 112, and adapter plate 114, collectively referred to above as module carousel base 130, are positioned directly on the scale platform 160.

In other embodiments, the modular bagging station 100, including the carousel top 113 and the bearing plate 112, and the adapter plate 114 may be positioned on or integrated with the scale platform 160. The weight of the bagging station 100 is predetermined and subtracted by a weight calculator when weighing a combination of store items to determine whether or not the purchase is correct. The weight data is calculated to be within a predetermined threshold of the scale 160. Shopping bags positioned on the bag holding elements 120 and/or edge holders 121 may be at least partially filled with store items received from an upstream region of a self-checkout system, for example, from a region of a checkout counter where the items are previously scanned, weighed, and purchased. Other store items not placed in shopping bags may be weighed by a region 161 of the top surface of the scale platform not occupied by the modular bagging station 100.

Figure 5:
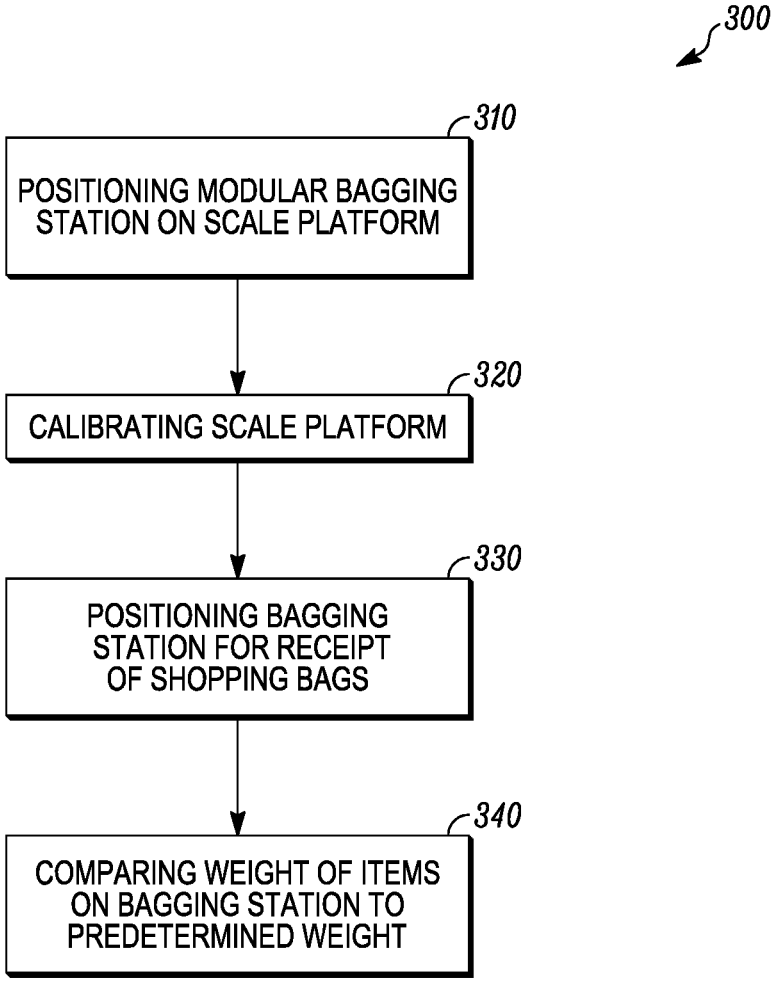
FIG. 5 illustrates a method of operating a bagging station at a self-checkout counter, in accordance with some embodiments.

FIG. 5 illustrates a method 300 of operating a bagging station at a self-checkout counter, in accordance with some embodiments. In describing the method 300, reference may be made to elements of FIGS. 1-4.

At block 310, modular bagging station 100 is positioned on scale platform 160. As described above, the bagging station 100 may be removably positioned on scale platform 160 so that at times the bagging station 110 may be removed from the scale platform 160 so that the surface of the scale platform previously occupied may be used to weight items positioned directly on the scale platform 160. As also described above, in other embodiments, the bagging station 100 may be integrated with the scale platform 160.

At block 320, the scale platform 160 is calibrated to compensate for the weight of the bagging station 100. The scale platform 160 may communicate with a remote processor that compares the weight of the store items with a predetermined weight to ensure that the items purchased are the same as the items leaving the store, i.e., for security reasons. The weight of the bagging station 100 cannot be part of the weight calculation. The weight of the carousel and/or other elements of the bagging station 100 on the scale 160 can be set to 0 so that these elements are not accounted for in a weight determination of items loaded in bags and hanging from the bagging station 100 during a self-checkout operation.

At block 330, the bagging station 100 is rotated or otherwise positioned to receive store items for insertion into at least one shopping bag hanging from the bagging station 100, which are at least partially filled with store items. The bagging station 100 may rotate about an axis that extends perpendicularly from the scale platform 160. The bagging station 100, or more specifically, the center piece 116 and carousel top portion 113, may be rotated by a shopper or other person so that at least one holding element 120, 121 is directly downstream of the store items in a path from a cash register of the self-checkout system.

At block 340, a combined weight of items inserted in shopping bags, which in turn are positioned on bag holding elements 120 and/or edge holders 121. Other store items may be placed on the top surface 161 of the scale platform 160. The store items may have been previously scanned, weighed, and purchased, i.e., payment made for the store items. Here, the scale platform 160 may be at a post-scan region of a self-checkout counter, and may serve as a security device, to ensure that the items purchased are indeed the items leaving the store with the shopper. Other security devices such as cameras or other sensors may be part of the self-checkout system, and communicate with a processor of the scale platform to collect data and provide the data to a store computer, airport terminal, or other security region where weight-related information is important to security, and which stores item data, tallies the items, and provides the purchase information to accounting and inventory databases.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A mobile, modular bagging station comprising:

a rotatable carousel base constructed and arranged for positioning on a self-checkout scale platform;

a center piece coupled to a top surface of the carousel base; and a plurality of holding elements extending from the center piece, wherein a weight of a plurality of store items in shopping bags positioned on the holding elements is determined by the scale platform on which the carousel base is positioned, wherein the carousel base comprises:

a rotatable carousel top portion, which includes the top surface of the carousel base on which the center piece is coupled;

a bearing plate directly coupled to a bottom surface of the carousel top portion; and an adapter plate at a bottommost region of the base, the adapter plate including a hole extending through a central region of the adapter plate to expose a surface of the scale platform under the adapter plate and in direct contact with the adapter plate, the bearing plate positioned in the hole of the adapter plate so that the adapter plate is in communication with the bearing plate, the bearing plate having a top surface protruding from the hole in the adapter plate permitting the carousel top portion to rotate over the exposed surface of the scale platform and relative to the adapter plate, the adapter plate having a flat surface along its length that is constructed and arranged to directly abut a flat surface of the scale platform that senses a weight of the adapter plate.

2. The bagging station of claim 1, wherein the holding elements include at least one of hooks, rods, clamps, spring clips, or other extensions for holding a shopping bag and its contents.

3. The bagging station of claim 1, wherein the holding elements include a combination of bag holding elements and edge holders.

4. The bagging station of claim 1, wherein the carousel base rotates relative to the scale platform so that at least one holding element of the plurality of holding elements is directly downstream of the store items in a path from a cash register of a self-checkout system.

5. The bagging station of claim 1, wherein the center piece comprises three sides and a top portion.

6. A system for self-checkout of store items, comprising:

a self-checkout scale platform;

a bagging station on the self-checkout scale platform and rotates about an axis perpendicular to the scale platform, wherein the self-checkout scale platform weighs a plurality of store items in shopping bags hanging from the bagging station, wherein the bagging station comprises:

a rotatable carousel top portion;

a bearing plate directly coupled to a bottom surface of the carousel top portion; and an adapter plate at a bottommost region of the carousel, the adapter plate including a hole extending through a central region of the adapter plate to expose a surface of the scale platform under the adapter plate and in direct contact with the adapter plate, the bearing plate positioned in the hole of the adapter plate so that the adapter plate is in communication with the bearing plate, the bearing plate having a top surface protruding from the hole in the adapter plate permitting the carousel top portion to rotate over the exposed surface of the scale platform and relative to the adapter plate, the adapter plate having a flat surface along its length that is constructed and arranged to directly abut a flat surface of the scale platform that senses a weight of the adapter plate, the self-checkout scale platform having a lip forming a perimeter about the flat surface of the scale platform, the bagging station surrounded by the lip; and a weight calculator that compares a weight of the store items in the shopping bags hanging from the bagging station, and a weight of the items upstream from the bagging station.

7. The system of claim 6, further comprising:

a self-checkout cash register upstream from scale platform;

a weight scale upstream from the cash register, wherein the store items are first weighed on the weight scale, purchased at the cash register, and a weight comparator that compares a weight of the store items determined at the scale platform compared to a weight of the store items at the weight scale.

8. The system of claim 7, wherein the self-checkout scale platform includes a region adjacent the bagging station for weighing items not in the shopping bags.

9. The system of claim 7, wherein a weight of a combination of the store items in the shopping bags and the items not in the shopping bags is determined by the weight calculator.

10. The system of claim 7, wherein the bagging station comprises a rotatable carousel base constructed and arranged for positioning on a self-checkout scale platform; a center piece coupled to a top surface of the carousel base; and a plurality of holding elements extending from the top portion, wherein a weight of a plurality of store items in shopping bags positioned on the holding elements is determined by the scale platform on which the carousel base is positioned.

11. The system of claim 10, wherein the holding elements include at least one of hooks, rods, clamps, spring clips, or other extensions for holding a shopping bag and its contents.

12. The system of claim 10, wherein the holding elements include a combination of bag holding elements and edge holders.

13. The system of claim 10, wherein the carousel base rotates relative to the scale platform so that at least one holding element of the plurality of holding elements is directly downstream of the store items in a path from a cash register of a self-checkout system.

14. A method for providing security at a weigh station, comprising:

positioning a modular bagging station on a scale platform, the bagging station comprising:

a rotatable carousel top portion;

a bearing plate directly coupled to a bottom surface of the carousel top portion; and an adapter plate including a hole extending through a central region of the adapter plate to expose a surface of the scale platform under the adapter plate and in direct contact with the adapter plate, the bearing plate positioned in the hole of the adapter plate so that the adapter plate is in communication with the bearing plate, the bearing plate having a top surface protruding from the hole in the adapter plate permitting the carousel top portion to rotate over the exposed surface of the scale platform and relative to the adapter plate, the adapter plate having a flat surface along its length that is constructed and arranged to directly abut a flat surface of the scale platform that senses a weight of the adapter plate, the scale platform having a lip forming a perimeter about the flat surface of the scale platform, the bagging station surrounded by the lip, the method further comprising:

positioning a plurality of shopping bags on the bagging station;

inserting store items purchased upstream from the scale platform into the shopping bags;

weighing by the scale platform the items in the shopping bags on the bagging station; and comparing a weight result with a weight of the items determined upstream from the bagging station.

* * * * *